United States Patent [19]

Frederick

[11] Patent Number: 4,638,885

[45] Date of Patent: Jan. 27, 1987

[54] COMBINATION SAWHORSE AND SAWBUCK

[76] Inventor: Raymond L. Frederick, 7425 NW. Anderson Hill Rd., Silverdale, Wash. 98383

[21] Appl. No.: 678,774

[22] Filed: Dec. 6, 1984

[51] Int. Cl.[4] ..... B27B 21/00; B25B 1/20

[52] U.S. Cl. ..... 182/151; 182/181; 182/224; 269/902

[58] Field of Search ..... 182/151, 224, 225, 153–155, 182/181–186; 269/296, 902

[56] References Cited

U.S. PATENT DOCUMENTS

| | | | |
|---|---|---|---|
| 31,605 | 3/1861 | Ires | 269/296 |
| 274,304 | 3/1883 | Halleck . | |
| 691,633 | 1/1902 | Jincks et al. | 269/296 |
| 931,793 | 8/1909 | Ott | 269/296 |
| 951,399 | 3/1910 | Kemp . | |
| 1,889,561 | 11/1932 | Morse | 269/296 |
| 2,654,923 | 10/1953 | Johnson | 403/8 |
| 2,699,601 | 1/1955 | Darnell | 269/296 |
| 2,733,740 | 2/1956 | Little . | |
| 3,089,682 | 5/1963 | Parker | 182/181 |
| 3,300,245 | 1/1967 | Rumble | 182/151 |
| 3,843,110 | 10/1974 | Smith | 269/296 |
| 3,883,104 | 5/1975 | Delafield | 211/182 |
| 4,121,814 | 10/1978 | Prior | 269/902 |
| 4,182,432 | 1/1980 | Cossitt | 182/151 |
| 4,386,678 | 6/1983 | Wendell | 182/182 |
| 4,433,753 | 2/1984 | Watson | 182/151 |

*Primary Examiner*—Reinaldo P. Machado

[57] ABSTRACT

A combination sawhorse and sawbuck comprising a horizontal member supported at either end by a pair of leg assemblies, and a number of removable members provided with V-shaped notches which convert the device from a sawhorse to a sawbuck. The various members of the leg assembly are coupled together by half-lap joints, and bolts extend through the half-lap joints into the horizontal member to engage tee nuts provided therein.

14 Claims, 5 Drawing Figures

COMBINATION SAWHORSE AND SAWBUCK

BACKGROUND OF THE INVENTION

1. Field of the Invention

This invention relates generally to sawhorses and sawbucks.

2. Description of the Prior Art

Sawhorses generally include a long, horizontal member supported at either end by inverted, V-shaped leg assemblies. Sawhorses are often used in pairs to permit the sawing of long wooden planks or boards.

Sawbucks are of similar construction to sawhorses except that the leg assemblies of the sawbucks are X-shaped rather than the inverted V-shaped legs of the sawhorse. The upper portion of the X-shaped legs are adapted to engage and hold a log or other wooden work piece essentially parallel to the horizontal member of the sawbuck.

The prior art discloses a great number and variety of sawbucks and sawhorses. One device is described in U.S. Pat. No. 4,121,814 of Prior and includes a sawbuck attachment for sawhorses. The attachment includes a pair of toothed, V-shaped members provided with downwardly extending channels which engage the horizontal member of a sawhorse.

Some sawhorses of the prior art, such as the ones disclosed in U.S. Pat. Nos. 4,386,678; 2,733,740; 274,304; and 951,399 teach sawhorses and sawbucks which are collapsible for compact storage. A problem with collapsible sawhorses and sawbucks is that they are either not as sturdy in construction as non-collapsible sawhorses and sawbucks, or they are provided with a number of braces which increase the weight, cost, and complexity of the devices.

Other patents including U.S. Pat. Nos. 4,325,543; 4,133,412; 2,652,079; and 530,601 teach sawhorses and sawbucks of solid construction. A problem with these sawbucks and sawhorses, however, is that they are quite bulky and are difficult to store.

What the prior art fails to disclose, then, is a combination sawhorse and sawbuck which may be easily disassembled for compact storage, and which forms a rigid, solid assemblage.

SUMMARY OF THE INVENTION

An object of this invention is to provide a combination sawhorse and sawbuck.

Another object of this invention is to provide a combination sawhorse and sawbuck which may be quickly disassembled and reassembled.

Yet another object of this invention is to provide a combination sawhorse and sawbuck which is rigid and sturdy when assembled without the need for cross-bracing.

Briefly, the invention includes a first leg assembly, a second leg assembly substantially identical to the first leg assembly, a horizontal member attached between the first leg assembly and the second leg assembly, and a number of removable members provided with V-shaped recessses. The removable members are provided with a slot at a lower end thereof which engages vertical surface grooves provided in the horizontal member.

Each leg assembly includes a pair of legs coupled together with a half-lap joint. A pair of bolts extend through the half-lap joints of the legs and into the horizontal member where they engage tee nuts provided within bore holes in the horizontal members.

The combination sawhorse and sawbuck can be quickly disassembled by unscrewing the bolts from the tee nuts and taking apart the leg assemblies. When the removable members are engaged with the slots of the horizontal member, the device can be used as a sawbuck, and the removable members can be disengaged from the horizontal member to convert the device into a sawhorse.

An advantage of this invention is that the combination of the half-lap joint of the leg members with their bolt and tee nut attachment to the horizontal member provides an extremely strong, lightweight, and rigid combination sawhorse and sawbuck without the use of cross braces.

Another advantage of this invention is that the sawhorse and sawbuck can be quickly disassembled for flat, compact storage.

Yet another advantage of this invention is that the device can be quickly converted from a sawhorse to a sawbuck and vice versa by the addition and removal of the removable members.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
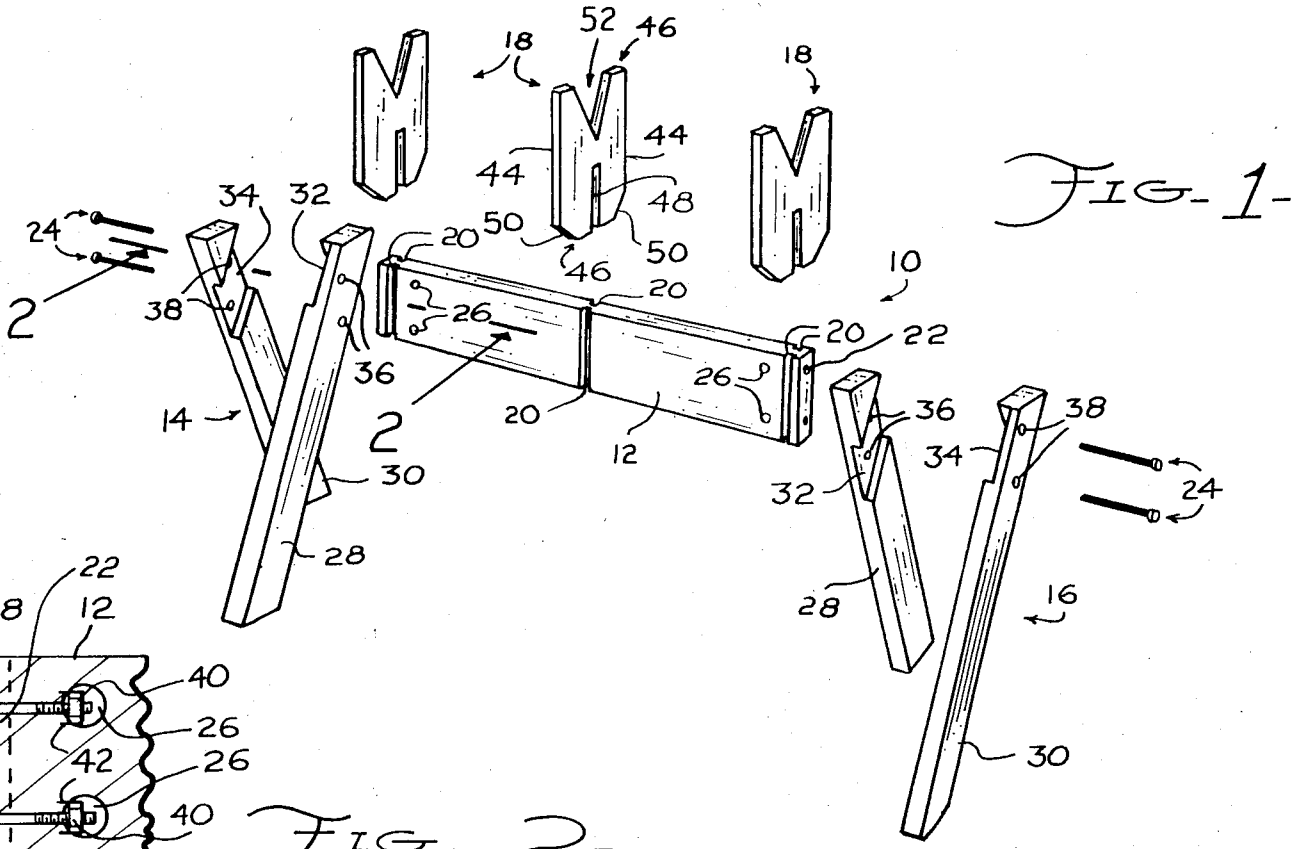
FIG. 1 is a an exploded, perspective view of a combination sawhorse and sawbuck in accordance with the present invention.

Referring to the exploded perspective view of FIG. 1, a combination sawhorse and sawbuck 10 in accordance with the present invention includes a horizontal member 12 and two leg assemblies 14 and 16. The combination sawhorse and sawbuck 10 also includes a number of removable members 18.

Figure 2:
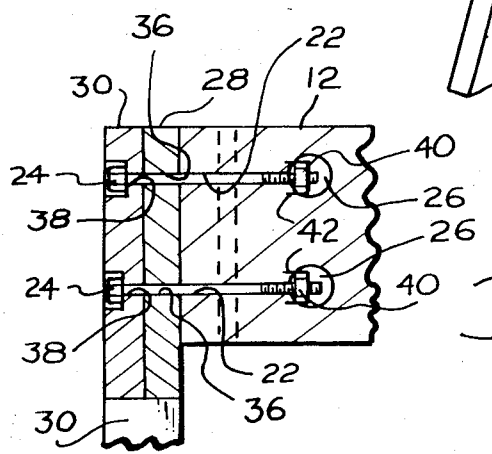
FIG. 2 is a cross sectional view taken through an end portion of a assembled combination sawhorse and sawbuck.

With additional reference to FIG. 2, horizontal member 12 is preferably made from a 2×6 wooden board and is provided with three pairs of vertical slots 20. The ends of horizontal member 12 are provided with bore holes 22 which are receptive to the shanks of machine bolts 24. The horizontal member 12 is also provided with four transverse bore holes 26 which as, best seen in FIG. 2, intersects with bore holes 22.

Leg assemblies 14 and 16 are substantially mirror images of each other, and like numerals will refer to like components thereof. Each leg assembly 14/16 includes a pair of legs 28 and 30 attached together in an inverted V-shape. Leg 28 is provided with a half-lap groove 32, and leg 30 is provided with a half-lap groove 34. When the half-lap grooves 32 and 34 are engaged, a strong half-lap joint is formed between legs 28 and 30.

Leg 28 is provided with a pair of bores 36, and leg 30 is provided with a pair of bores 38. As best seen in FIG.

2, when the leg assembly 14/16 are assembled to the horizontal member 12, bore holes 22, 36, and 38 are aligned to permit bolts 24 to extend into bore holes 26.

Still referring to FIG. 2, a pair of tee nuts 40 are provided within bore hole 26 to engage the ends of bolts 24. The tee nuts are provided with prongs 42 which engage the inner surface of bore hole 26 so that they retain their position within bore holes 26 even after bolts 24 are removed.

Removable members 18 are substantially rectangular in shape and include a pair of longer sides 44 and a pair of shorter sides 46. The shorter side is provided with slot 48 which can engage grooves 20 and a pair of beveled surfaces 50 to blunt the sharp lower corners of the removable member 18. The upper end is provided with a V-shaped recess 52 which, as will be discussed subsequently, is adapted to hold a log or other wooden member.

Figure 3:
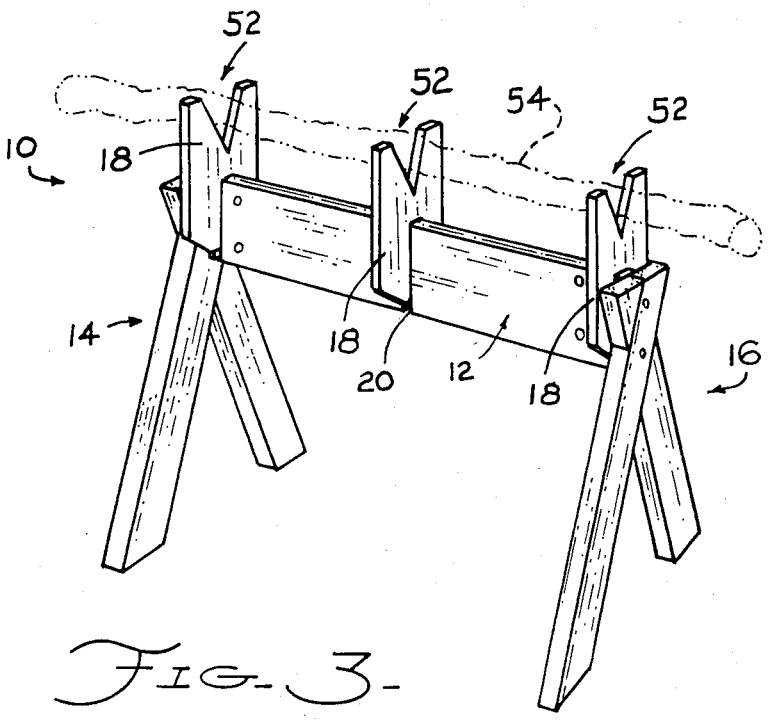
FIG. 3 illustrates the use of the present device as a sawbuck.

The operation of the present invention will be discussed with reference to FIGS. 3 and 4. In FIG. 3, the leg assemblies 14 and 16 are shown assembled to the horizontal member 12, and removable members 18 are engaged with the grooves 20 of the horizontal member. A log or stick 54 is held in place within V-shaped recesses 52 of removable members 18. Thus, in this configuration, the device is being used as a sawbuck.

Figure 4:
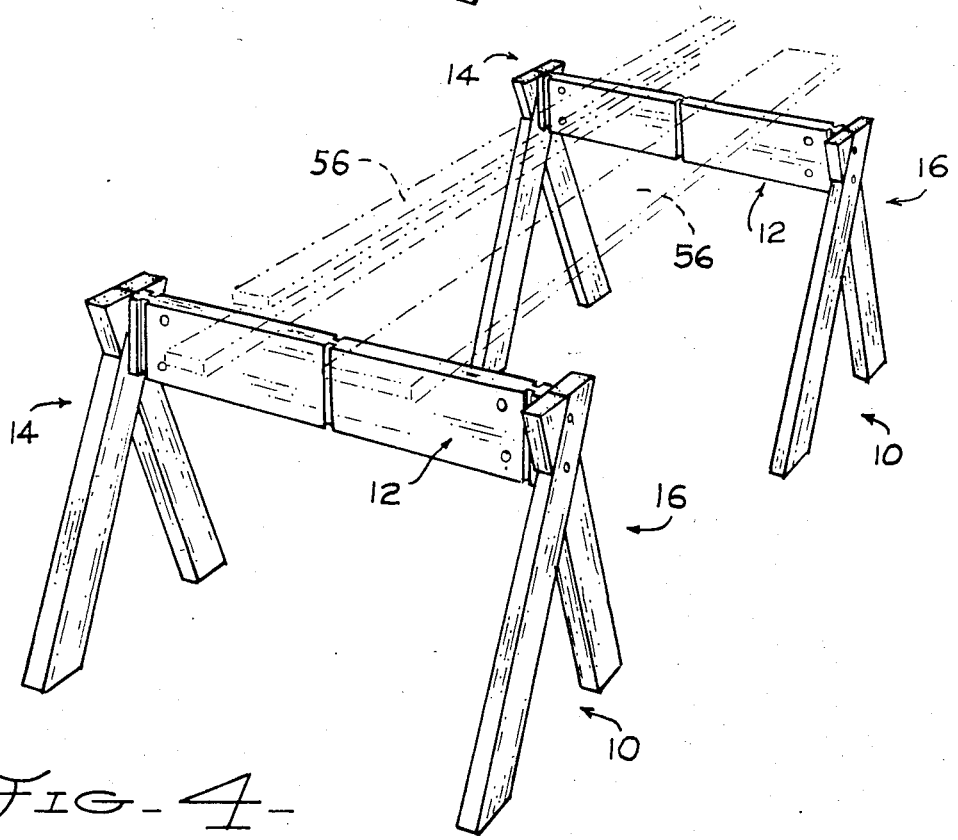
FIG. 4 illustrates the use of a pair of the present devices in their sawhorse configurations.

In FIG. 4, a pair of combination sawhorse and sawbucks 10 are shown being used in their sawhorse configuration. The removable members have been removed from the horizontal members such that planks of wood 56 may be extended between them.

Figure 5:
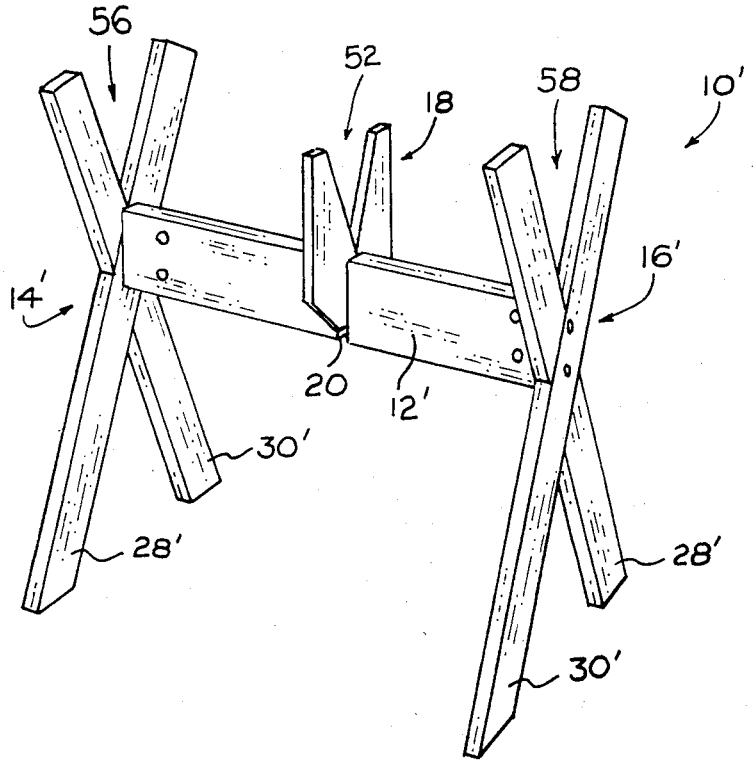
FIG. 5 is a perspective view of an alternate embodiment of the present invention.

Referring now to FIG. 5, an alternate embodiment 10' of the present invention includes a horizontal member 12', a pair of leg assemblies 14' and 16', and a removable member 18. As before, removable member 18 engages vertical grooves 20 formed on the sides of horizontal members 12'. The embodiment of FIG. 5 differs from the embodiments of FIGS. 1–4 in that the leg assemblies 28' and 30' extend beyond the upper surface of horizontal member 12 to form V-shaped recesses 56 and 58. V-shaped recesses 56 and 58 cooperate with the V-shaped recess 52 of removable member 18 to hold a log or other workpiece.

The combination sawhorse and sawbucks 10/10' may be quickly disassembled by removing bolts 24 and storing the various members flat. The tee nuts 40 are retained within bores 26 by their prongs 42. The combination sawhorse and sawbucks 10/10' can be reassembled by engaging the legs 28/28' with legs 30/30' and bolting the leg assemblies 14/14' and 16/16' to horizontal members 12/12' with bolts 24.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A combination sawhorse and sawbuck comprising:

a first leg assembly;

a second leg assembly which is substantially identical to said first leg assembly;

a horizontal member having first and second opposed ends and first and second opposed sides, said first end attached to said first leg assembly and said second end attached to said second leg assembly, said first side having a first vertical surface groove and said second side having a second vertical surface groove; and at least one removable member provided with a slot at a lower end thereof which is adapted to simultaneously engage said first and said second vertical surface grooves of said horizontal member, each removable member having a V shaped recess at an upper end thereof receptive to a work piece.

2. A combination sawhorse and sawbuck as recited in claim 1 wherein said removable member is a first removable member and further comprising additional removable members of substantially the same configuration as said frist removable member which are engageable with additional vertical grooves provided on said horizontal member.

3. A combination sawhorse and sawbuck as recited in claim 2 wherein each of said removable members are substantially rectangular with a vertical major axis, and wherein said slot extends vertically from a lower edge and said V shaped recess extends downwardly from an upper edge.

4. A combination sawhorse and sawbuck as recited in claim 3 wherein the lower corners of each of said removable members are blunted.

5. A combination sawhorse and sawbuck as recited in claim 1 wherein said each of said leg assemblies includes a first leg member, and a second leg member crossing said first leg member.

6. A combination sawhorse and sawbuck as recited in claim 5 wherein said first leg member and said second leg member are joined together with a half lap joint.

7. A combination sawhorse and sawbuck as recited in claim 6 having a plurality of fastening bolts, said horizontal member having at least one bore extending between said first side and said second side in proximity of each end of said horizontal member, said bores each having a means for engaging a fastening bolt, each of said bolts extending through a half lap joint of said leg assemblies, said bolts each having a tip extending into said bores of said horizontal member for engagement with said means for engaging a bolt.

8. A combination sawhorse and sawbuck as recited in claim 7 wherein said means for engaging a fastening bolt is a tee nut, said tee nuts each disposed within a bore and engaging said tip of a bolt, said tee nuts each having a plurality of prongs embedded into said horizontal member.

9. A combination sawhorse and sawbuck comprising:

a first leg assembly and a second leg assembly, where each of said leg assemblies include a first leg member and a second leg member crossing said first leg member, said first leg member and said second leg member being joined together with a half lap joint;

a horizontal member attached at a first end to said first leg assembly and attached at a second end to said second leg assembly, wherein said horizontal member is provided with at least one bore extending between said first side and said second side proximate both ends thereof;

at least one bolt extending through the half lap joint of each of said leg assemblies, the tip of said bolt extending into a bore of said horizontal member, and a nut disposed within said bore and engaging said tip of said bolt; and at least one removable member provided with a slot at a lower end thereof which is adpated to engage an upper edge of said horizontal member, and a V shaped recess provided at an upper end thereof receptive to a work piece, wherein said horizontal member is provided with a first vertical surface groove on a first side thereof and a second vertical surface groove on a second, opposing side thereof, where said slot of said removable member can engage said first vertical surface groove and said second vertical surface groove simultaneously.

10. A combination sawhorse and sawbuck as recited in claim 9 wherein said removable member is a first removable member and further comprising additional removable members of substantially the same configuration as said first removable member which are engagable with additional vertical grooves provided on said horizontal member.

11. A combination sawhorse and sawbuck as recited in claim 10 wherein each of said removable members are substantially rectangular with a vertical major axis, and wherein said slot extends vertically from a lower edge and said V shaped recess extends downwardly from an upper edge.

12. A combination sawhorse and sawbuck as recited in claim 11 wherein the lower corners of each of said removable members are blunted.

13. A knock-down sawhorse device comprising:

a first pair of legs joined together at a first lap joint, and a second pair of legs joined together at a second lap joint; said first lap joint being provided with a first lap bore extending through said first pair of legs, and said second lap joint being provided with a second lap bore extending through said second pair of legs;

a horizontal member having a first end, a second end, and two opposing side surfaces; where said horizontal member is attached at a first end to said first pair of legs and is attached at a second end to said second pair of legs; said horizontal member being provided with a first longitudinal bore opening on said first end and a first transverse bore which extends between said two opposing side surfaces and which intersects said first longtidinal bore; said horizontal member being further provided with a second longitudinal bore opening on said second transverse bore which extends between two opposing side surfaces and which intersects said second longitudinal bore; and a first tee nut and first bolt said first bolt extending through said first lap bore, said first longitudinal bore, and into said first transverse bore, said first tee nut disposed in said first transverse bore for engagement with said first nut, a second bolt extending through said second lap bore, said second longitudinal bore, and into said second transverse bore, second transverse bore containing a second tee nut for engagement with said second bolt.

14. A combination sawhorse and sawbuck as recited in claim 9 having a plurality of said bores extending between said first side and said second side, said bores each having circumferential surface said nuts having prongs extending into said circumferential surface.

* * * * *